United States Patent [19]

Newby

[11] Patent Number: 5,071,095

[45] Date of Patent: Dec. 10, 1991

[54] UTILITY CLAMP APPARATUS

[76] Inventor: G. Michael Newby, 21077 Old Farm Rd., Bakersfield, Calif. 93312

[21] Appl. No.: 504,667

[22] Filed: Apr. 4, 1990

[51] Int. Cl.[5] ..... A46B 17/02

[52] U.S. Cl. ..... 248/113; 248/316.3; 211/66; 211/89

[58] Field of Search ..... 248/110, 113, 316.2, 248/316.3; 211/65, 66, 89

[56] References Cited

U.S. PATENT DOCUMENTS

| | | | |
|---|---|---|---|
| 1,563,817 | 12/1925 | Wright | 248/316.3 |
| 1,958,772 | 5/1934 | Stewart | 248/316.3 |
| 2,153,840 | 4/1939 | Margolith | 248/316.3 |
| 3,161,393 | 12/1964 | Swanson | 248/113 |
| 3,178,141 | 4/1965 | Bloom | 248/113 |
| 3,294,350 | 12/1966 | Grottola et al. | 248/113 |
| 3,520,988 | 7/1970 | Bullock, Sr. | 439/502 |
| 3,672,619 | 6/1972 | Bowen | 248/113 |
| 3,780,874 | 12/1973 | Stacy | 248/316.3 |
| 3,833,906 | 9/1974 | Augustine | 342/174 |
| 4,326,653 | 4/1982 | Stone | 224/312 |
| 4,647,139 | 3/1987 | Yang | 439/503 |
| 4,760,497 | 7/1988 | Roston | 439/534 |
| 4,783,619 | 11/1988 | Herman | 439/504 |

*Primary Examiner*—Gary L. Smith

*Assistant Examiner*—Suzanne L. Dino

*Attorney, Agent, or Firm*—Leon Gilden

[57] ABSTRACT

Apparatus including an elongate support plate mounting a plurality of spaced clamp members therealong at predetermined spaced intervals. Each clamp member includes a clamp support plate spaced form the elongate support plate rotatably mounting a plurality of clamp arms defining medial clamp members each including a free terminal upper end oriented in an opposed direction along the support plate. A single engagement arm is mounted on an end clamp member with the single arm directed interiorly of the elongate support. Each arm includes a resilient curved linear engagement nose for securement of a handle rod between pairs of clamp arms of separate clamp members.

A modification of the instant invention includes a series of radially arranged resilient fingers directed exteriorly and radially of the nose forming a series of recesses therebetween with a plurality of upper recesses of the series of recesses mounting a plural pair of engagement pins therebetween whereupon rotation of the arms into a downward clamping configuration directs the pins into a rod to be supported to enhance securement thereof.

3 Claims, 4 Drawing Sheets

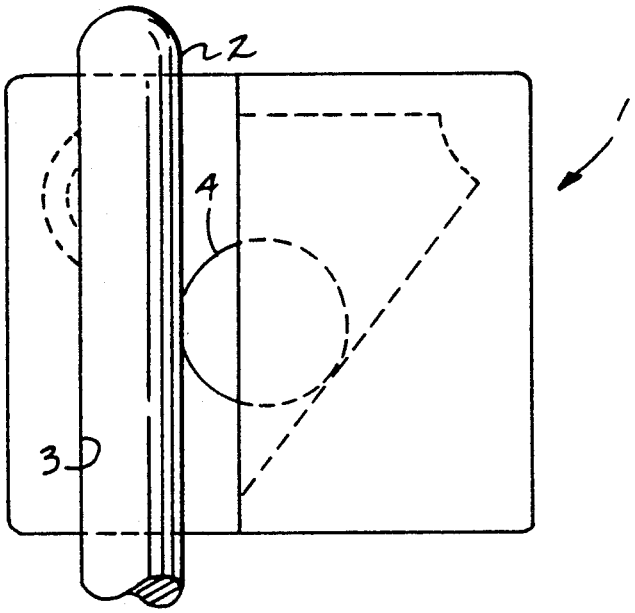
Fig 1
PRIOR ART
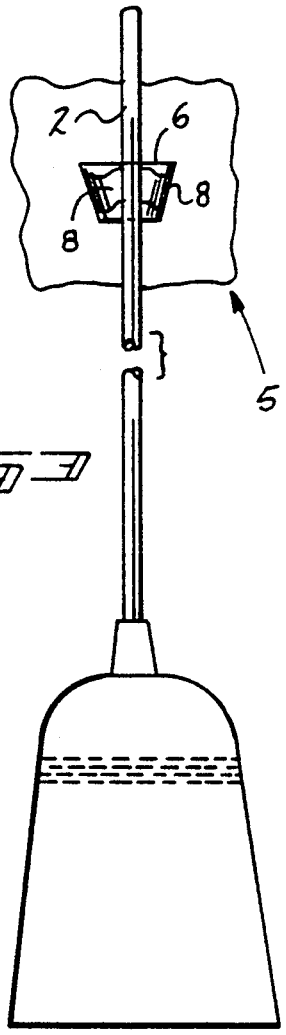
Fig 3
PRIOR ART
Fig 2
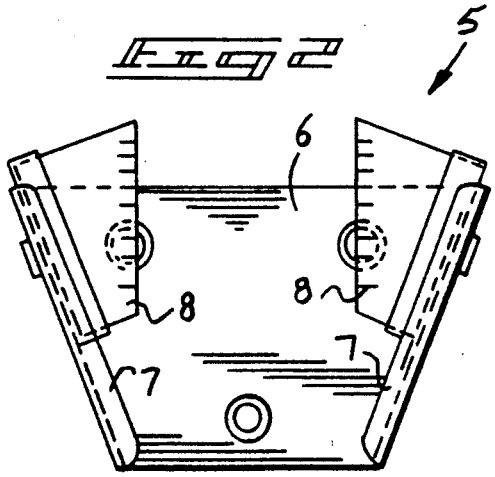
PRIOR ART

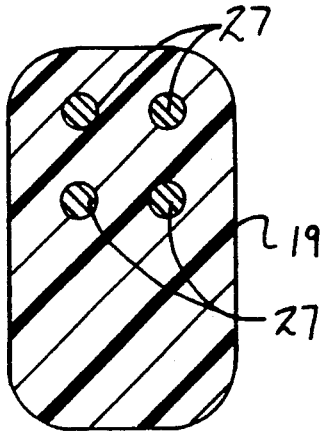
FIG 6
FIG 7
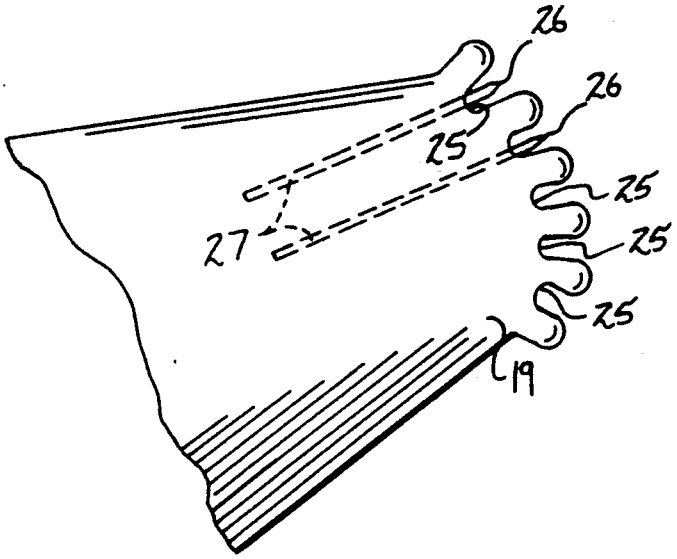

UTILITY CLAMP APPARATUS

BACKGROUND OF THE INVENTION

1. Field of the Invention

The field of the invention relates to clamp apparatus, and more particularly pertains to a new and improved utility clamp apparatus wherein the same utilizes a plurality of spaced engagement arms to secure elongate rods therebetween.

2. Description of the Prior Art

Utility clamp apparatus to secure elongate rods to maintain the same in an orderly fashion have been provided in the prior art. Heretofore however such organizations have frequently been of varying effectiveness or of unnecessarily cumbersome organization to effect this purpose.

Examples of the prior art include U.S. Pat. No. 3,178,141 to BLOOM utilizing plurality of opposed sliding engagement members mounted within opposing grooves directed and oriented in a generally V-shaped relationship relative to one another to engage a rod therebetween.

U.S. Pat. No. 3,294,350 to GROTTOLA et al wherein a elongate rod is positioned within a groove wherein a rolling cylinder mounted within a recess is directed downwardly by means of gravity to clamp an elongate rod between an opposing wall of the groove and the cylinder.

U.S. Pat. No. 3,161,393 to SWANSON sets forth a clamp assembly utilizing a spring bias L-shaped clamp lever cooperative with a confronting plate to clamp a rod therebetween.

U.S. Pat. No. 3,672,619 to BOWENS sets forth a clamp holder utilizing a serrated disk slidedly mounted within a groove diagonally oriented relative to a cooperating plate to clamp a rod therebetween.

As such, it may be appreciated there continues to be a need for a new and improved utility clamp apparatus as set forth by the instant invention where it addresses both the problems of ease of use as well as effectiveness in construction and in this respect, the present invention substantially fulfills this need.

SUMMARY OF THE INVENTION

In view of the foregoing disadvantages inherent in the known types of clamp apparatus now present in the prior art, the present invention provides an improved utility clamp apparatus wherein the same utilizes mounting pivotal arms to frictionally engage a rod therebetween. As such, the general purpose of the present invention, which will be described subsequently in greater detail, is to provide a new and improved utility clamp apparatus which has all the advantages of the prior art clamp apparatus constructions and none of the disadvantages.

To attain this, the utility clamp apparatus of the instant invention includes an apparatus including an elongate support plate mounting plurality of spaced clamp members therealong at spaced predetermined intervals.

Each clamp member includes a clamp support plate spaced from the elongate support plate rotatably mounting a plurality of clamp arms with defining clamp members each including a free terminal upper end oriented in an opposed direction along the support plate. A single engagement arm is mounted on an end clamp member with the single arm directed interiorly of the elongate support. Each arm includes a resilient curved linear engagement nose for securement of a handle rod between pairs of clamp arms of the spaced clamp members. A modification of the instant invention includes a series of radially arranged resilient fingers directed exteriorly and radially of the nose forming a series of recesses therebetween with a plurality of upper recesses of the series of recesses mounting a plural pair of engagement pins therebetween whereupon rotation of the arms into a downward clamping configuration directs the pins into a rod to be supported to enhance securement thereof.

There has thus been outlined, rather broadly, the more important features of the invention in order that the detailed description thereof that follows may be better understood, and in order that the present contribution to the art may be better appreciated.

There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved utility clamp apparatus which has all the advantages of the prior art utility clamp apparatus and none of the disadvantages.

It is another object of the present invention to provide a new and improved utility clamp apparatus which may be easily and efficiently manufactured and marketed.

It is a further object of the present invention to provide a new and improved utility clamp apparatus which is of a durable and reliable construction.

An even further object of the present invention is to provide a new and improved utility clamp apparatus which is susceptible of a low cost of manufacture with regard to both materials and labor, and which accordingly is then susceptible of low prices of sale to the consuming public, thereby making such utility clamp apparatuses economically available to the buying public.

Still yet another object of the present invention is to provide a new and improved utility clamp apparatus which provides in the apparatuses and methods of the prior art some of the advantages thereof, while simultaneously overcoming some of the disadvantages normally associated therewith.

Still another object of the present invention is to provide a new and improved utility clamp apparatus which may be compactly stored when not being utilized.

Yet another object of the present invention is to provide a new and improved utility clamp apparatus wherein the same resiliently and in a positive manner affectively clamps elongate rod therebetween utilizing a backup pin arrangement to ensure such a clamping relationship.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view taken in elevation of a prior art clamp apparatus.

FIG. 2 is an orthographic view taken in elevation of a further prior art clamp apparatus.

FIG. 3 is an orthographic view taken in elevation of the clamp apparatus of FIG. 2 in association with a rod member such as a handle.

FIG. 6 is an orthographic view taken along the lines 6—6 of FIG. 5 in the direction indicated by the arrows.

FIG. 7 is an orthographic view of section 7 as illustrated in FIG. 5.

DESCRIPTION OF THE PREFERRED EMBODIMENT

Figures 4, 5:
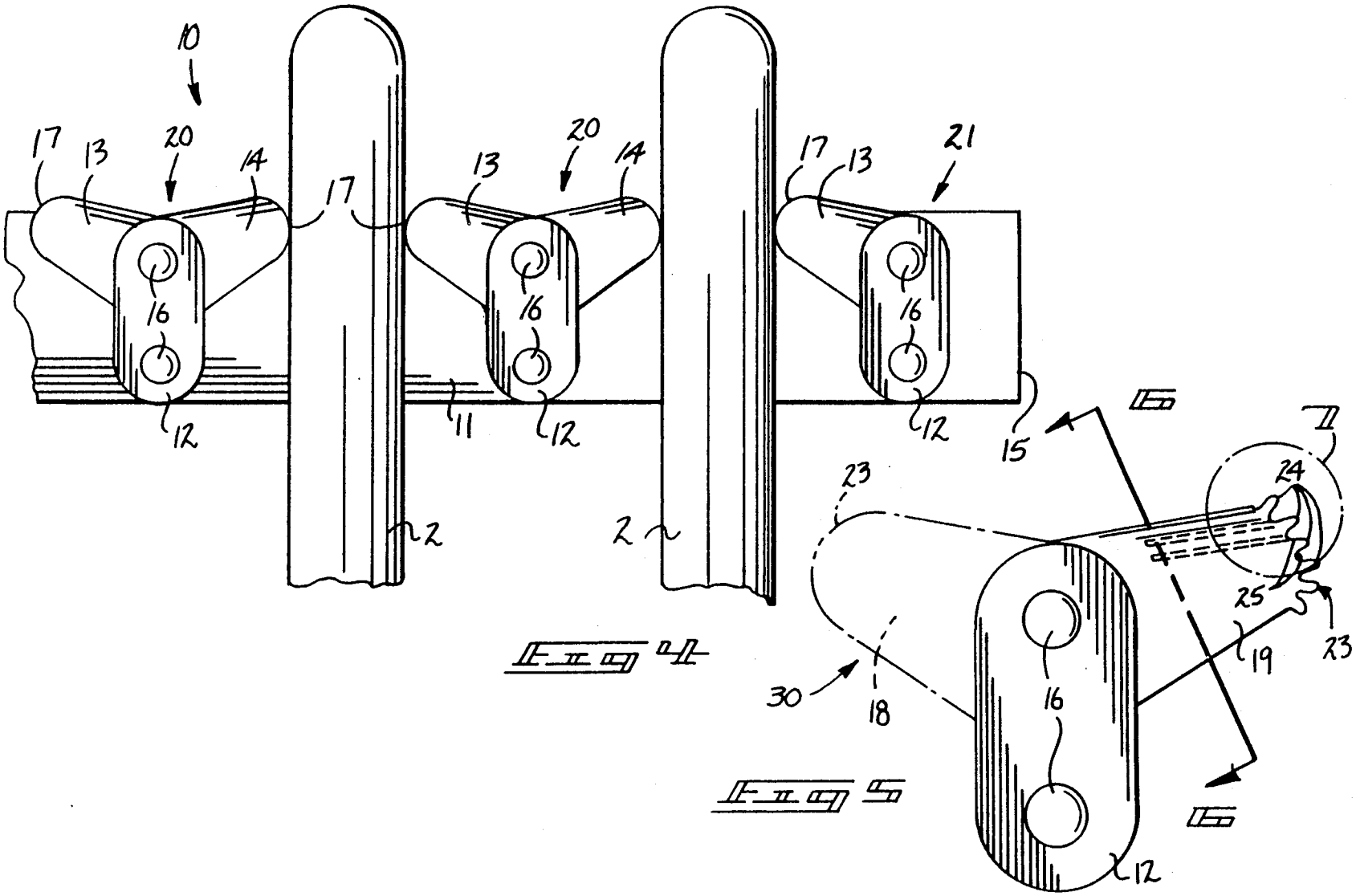
FIG. 4 is an orthographic view taken in elevation of the instant invention.
FIG. 5 is an orthographic view taken in elevation of a modification of the instant invention.
Figure 8:
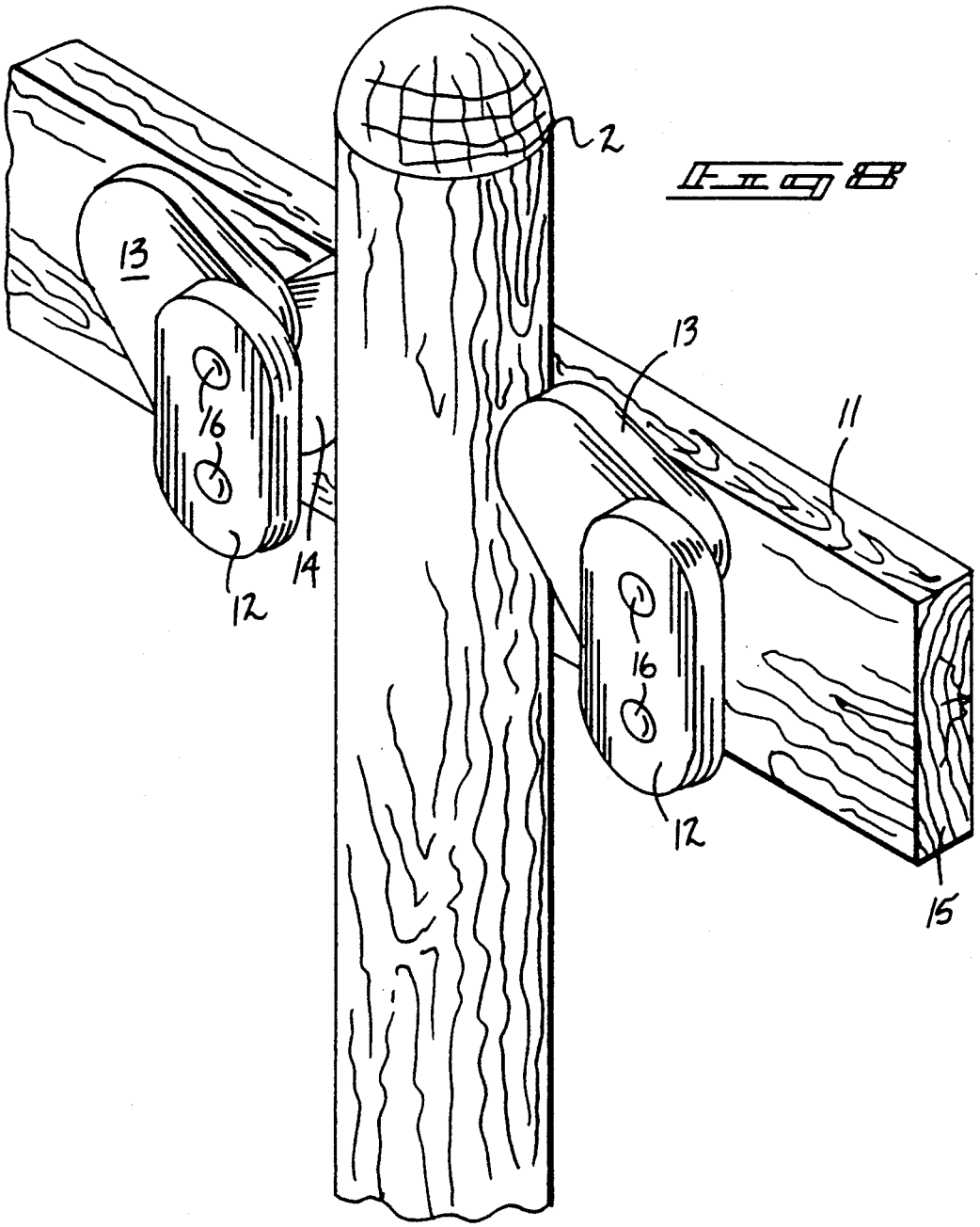
FIG. 8 is an isometric illustration of the instant invention.

With reference now to the drawings, and in particular to FIGS. 1 to 8 thereof, a new and improved utility clamp apparatus embodying the principles and concepts of the present invention and generally designated by the reference numeral 10 will be described.

FIG. 1 is illustrative of a prior art handle securement device 1 wherein elongate handle 2 is directed through a slot formed within a wall 3 that cooperates with a cylinder 4 to clamp the handle 2 between the wall 3 and the cylinder upon positioning of the handle therebetween. FIGS. 2 and 3 illustrate a further prior art clamping apparatus 5 wherein a bracket 6 includes U-shaped channels 7 angulated relative towards one another at a lower end of the channel with slides 8 mounted within each channel to be slidedly directed downwardly to clamp the aforenoted handle 2 therebetween.

More specifically, the utility clamp apparatus 10 essentially comprises an elongate planar support plate 11 formed with a series of clamp assemblies 20 mounted at equal spaced intervals therealong its forward face. An end clamp assembly 21 is mounted adjacent each terminal side edge 15 of the support plate 11 utilizing a single clamp arm as illustrated. Each of the clamp assemblies includes a positioning plate 12 mounted overlieing and in a spaced relationship relative to a forward surface of the support plate 11 wherein a left and right clamp arm 13 and 14 respectively are pivotally mounted within and between each positioning plate 12 on the forward surface of the support plate 11. As illustrated, the end clamp assembly 21 utilizes a single left clamp arm 13 wherein understandably the left-most clamp assembly (not shown) utilizes a single right clamp arm 14 each direct interiorly and parallel to the forward face of the support plate 11. The clamp arms are defined by a predetermined length defining a gap therebetween wherein each gap is of a predetermined spacing not to exceed and preferably less than that of a predetermined width of each handle or rod 2 mounted therebetween.

Further, each clamp arm is formed with a curvilinear engagement nose surface 17 forming a forward terminal grasping surface of each clamp pair defined by a cooperating left and right clamp arm 14 and 13. Each nose surface 17 is of a generally resilient construction to enhance engagement of a rod or handle 2 therebetween.

FIG. 2 is illustrative of a modified clamp assembly 30 illustrated in FIG. 5 utilizing a left clamp arm 18 and a right clamp arm 19. Both left and right clamp arms are utilized with an intermediate clamp assemblies as illustrated in FIG. 4 and is understood a left-most clamp assembly will utilize a single right clamp arm 19 whereas a right most clamp assembly 30 would utilize a single left clamp arm 18. Each clamp arm is formed with a engagement nose 23 defined by a series of resilient fingers members 24 spaced at predetermined intervals along the arcuate surface of each engagement nose 23 and defining a series of cavity recesses 25 therebetween. Each finger member 24 is formed of a resilient memory retentant material for engagement of a longitudinal rod surface of each rod 2.

Cavity recesses 25 each include plural pairs of rigid reinforcing and engagement spikes 26 mounted therewithin wherein a forward tip of each spike 26 is directed and extends beyond each cavity recess 25 but below the forward surface of each of the upper engagement finger members 24.

Upon positioning of a rod 2 between incorporating clamp pair of clamp arms 18 and 19, the arms 19 will rotate downwardly to effect engagement of the rod 2 therebetween. Should, however, the clamp arms rotate to a generally horizontal orientation, the pointed tips of spikes 26 will penetrate and engage the rod and maintain positioning of the rod avoiding its descent from between the modified clamp assembly 30.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A utility clamp apparatus comprising, an elongate plate mounting a clamp means thereon for securement of an elongate rod, the clamp means including at least a first and second clamp assembly, each clamp assembly including a clamp plate including spaced sides spatially mounted to and forwardly of the support plate including at least one fastener axle member directed through the clamp plate orthogonally into the support plate mounting the clamp plate to the support plate, and a first and second clamp arm extending outwardly of each side of the clamp plate of the first and second clamp assemblies and pivotally mounted at a lowermost end of each clamp arm to the fastener axial member, and each adjacent pair of spaced first and second clamp arms of spaced first and second clamp assemblies defining a clamp pair to secure the rod therebetween, and wherein each clamp arm includes a curvilinear forward engagement nose, and wherein each engagement nose is formed of a resilient memory retentent material, and wherein the clamp means further includes a left most clamp assembly mounted to the support plate adjacent the first clamp assembly and a right most clamp assembly mounted to the support plate adjacent the second clamp assembly, and the left most clamp assembly including a second clamp arm only extending outwardly of an associated clamp plate of the left most clamp assembly, and a right most clamp assembly including a first clamp arm only extending outwardly of a clamp plate associated with the right most clamp assembly, and wherein each clamp assembly mounted to the support plate is mounted at spaced equal intervals therealong, and wherein each engagement nose of each clamp arm includes a series of equally spaced flexible finger members extending outwardly thereof in alignment with each clamp arm, and where each finger member is formed of a resilient memory retentent material, and wherein adjacent finger members include a cavity recess formed between the adjacent finger members, and wherein at least one cavity recess includes at least one rigid engagement spike extending outwardly of each cavity recess and where the at least one spike is positioned below an outer terminal end of each finger member and each spike includes a pointed free end.

2. Apparatus set forth in claim 1 wherein each spike includes a shank directed interiorly of each clamp arm.

3. Apparatus set forth in claim 2 wherein the at least one cavity recess includes a plurality of spaced parallel spikes, and each of the spikes includes a respective shank and where the shanks are parallel relative to each other.

* * * * *